US006994219B2

(12) United States Patent
Roth et al.

(10) Patent No.: US 6,994,219 B2
(45) Date of Patent: Feb. 7, 2006

(54) METHOD FOR MAGNETIC/FERROFLUID SEPARATION OF PARTICLE FRACTIONS

(75) Inventors: Paul Gregory Roth, Cincinnati, OH (US); Richard Frederick Halter, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 8 days.

(21) Appl. No.: 10/764,769

(22) Filed: Jan. 26, 2004

(65) Prior Publication Data

US 2005/0178701 A1 Aug. 18, 2005

(51) Int. Cl.
*B03B 5/00* (2006.01)

(52) U.S. Cl. ..... 209/210; 209/214; 209/215; 209/216; 209/223.1; 209/38; 209/39; 209/40

(58) Field of Classification Search ..... 209/38, 209/39, 40

See application file for complete search history.

(56) References Cited

U.S. PATENT DOCUMENTS 3,483,968 A 12/1969 Kaiser
3,483,969 A 12/1969 Rosenweig
3,488,531 A 1/1970 Rosenweig
3,788,465 A 1/1974 Reimers et al.
3,898,156 A * 8/1975 Kaiser et al. ..... 209/1
3,951,785 A 4/1976 Kaiser et al.
4,052,297 A * 10/1977 Mir ..... 209/1
4,062,765 A * 12/1977 Fay et al. ..... 209/1
4,085,037 A * 4/1978 Quets et al. ..... 209/1
4,239,619 A 12/1980 Aplan et al.
4,347,124 A * 8/1982 Shimoiizaka et al. ..... 209/1
4,594,149 A 6/1986 Andres et al.
4,819,808 A 4/1989 Andres et al.
4,961,841 A 10/1990 Andres et al.
5,147,554 A * 9/1992 Heck ..... 210/695
5,340,472 A * 8/1994 Heck, deceased ..... 210/173
5,549,206 A 8/1996 Siesco, Jr.
5,762,204 A * 6/1998 Yang et al. ..... 209/172.5
5,957,298 A * 9/1999 Buske et al. ..... 209/39
6,026,966 A * 2/2000 Svoboda ..... 209/172.5
6,254,781 B1 * 7/2001 Raj ..... 210/695
6,851,557 B1 * 2/2005 Svoboda ..... 209/39

* cited by examiner

*Primary Examiner*—Donald P. Walsh
*Assistant Examiner*—Jonathan R Miller
(74) *Attorney, Agent, or Firm*—McNees Wallace & Nurick LLC

(57) ABSTRACT

A particulate feed comprising a first particle type and a second particle type is separated by providing a separation apparatus having a separation vessel having a top and a bottom, and wherein the separation vessel includes inwardly sloping side walls. A magnet structure has a first pole positioned exterior of and adjacent to each of the side walls of the separation vessel, and a second pole positioned above the separation vessel. A mixture of the particulate feed and a ferrofluid is introduced into the separation vessel, and the particulate feed is separated into a first particle fraction comprising a majority of the first particle type, which sinks in the separation vessel, and a second particle fraction comprising a majority of the second particle type which floats in the separation vessel.

18 Claims, 2 Drawing Sheets

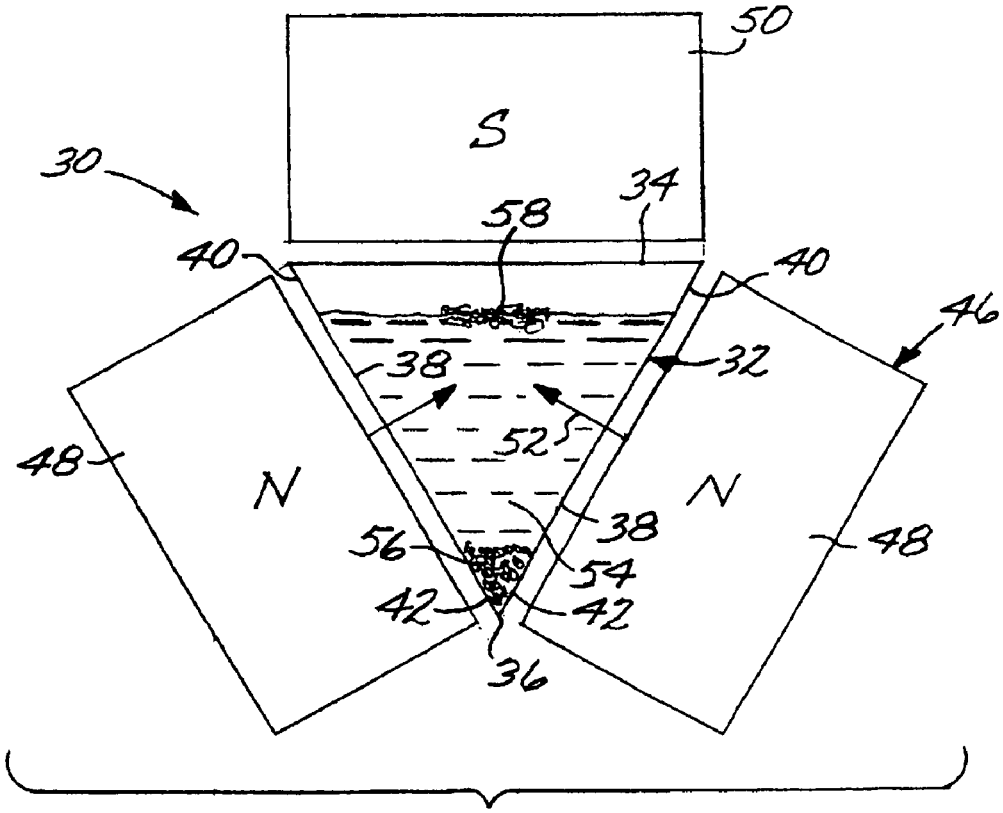
FIG. 2
FIG. 3
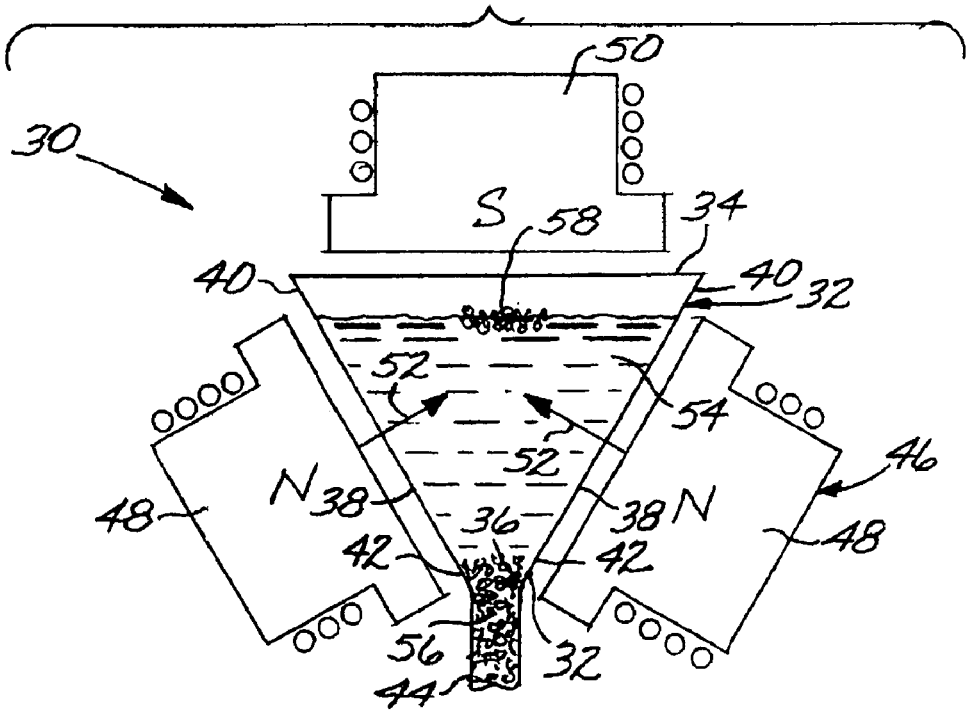

METHOD FOR MAGNETIC/FERROFLUID SEPARATION OF PARTICLE FRACTIONS

This invention relates to the separation of particle fractions from a particulate feed and, more particularly, to such a separation accomplished using ferrofluids and an applied magnetic field.

BACKGROUND OF THE INVENTION

Powder metallurgical processes offer an alternative to casting and casting-and-working for the production of metallic articles. In a powder metallurgical process, the alloy that is to constitute the article is first prepared in a fine-particle form. A mass of the alloy particulate is compacted to the required shape at elevated temperature with or without a binder. For example, hot isostatic pressing is a binderless process used to manufacture a number of aerospace and other types of parts. Where they can be used, powder metallurgical processes offer the advantages of a more-homogeneous microstructure in the final article, and reduced physical and chemical contaminants in the final article.

The powder used in the powder metallurgical process is typically produced by a method in which the precursor metal of the powder contacts the ceramics in melting crucibles or powder-production apparatus. The result is that the metallic powder particles are intermixed with a small fraction of fine ceramic particles. The presence of the ceramic particles may be acceptable or unacceptable, depending upon the size, composition, and volume fraction of ceramic particles that are present.

When a batch of powder material is received by the manufacturer of the final article from the manufacturer of the powder, the batch may be evaluated as to whether it is acceptable or unacceptable for use in the manufacturing of the final article. One test that may be used to make this evaluation requires that the ceramic fraction of the particles be separated from the metallic fraction, and that the ceramic fraction be chemically and physically analyzed. Flotation separation techniques involve mixing a particulate feed into a fluid of the proper density, so that the lighter ceramic particle fraction floats, and the heavier metallic particle fraction sinks. Currently available flotation fluids with the required high specific gravity to achieve this flotation separation include toxic elements such as the thallium component of Clerici's Reagent. An alternative magnetic separation technique uses a nontoxic ferrofluid with an applied magnetic field to effect a similar separation. Available magnetic separation apparatus is complex in structure and fragile. Because of the internal complexity, there are many places for the particles to be trapped within the apparatus. The result is that the apparatus is difficult to clean between runs, and there is a significant chance of cross-contamination between runs.

There is a need for an improved approach to the separation of particle fractions, as required for the analysis of the particles and other purposes. The present invention fulfills this need, and further provides related advantages.

SUMMARY OF THE INVENTION

The present invention provides a procedure for separating particulate feeds into a first particle fraction and a second particle fraction. The present approach achieves that separation in a convenient manner that allows the particle fractions to be easily collected for subsequent analysis. The apparatus is readily cleaned and prepared for subsequent separation runs. The present approach is particularly suited for analytical work using relatively small-volume powder samples.

This approach provides a method for separating a particulate feed comprising a first particle type and a second particle type, of differing densities and/or differing magnetic susceptibilities. In an application of interest, the first particle type is a non-magnetic metallic particle, and the second particle type is a non-magnetic ceramic particle of lower density than the metallic particle. The method includes first providing a separation apparatus. The separation apparatus comprises a separation vessel having a top and a bottom, wherein the separation vessel includes inwardly sloping side walls with a greater spacing at their top ends than at their bottom ends. A magnet structure has a first pole positioned exterior to and adjacent to each of the side walls of the separation vessel, and a second pole positioned above the separation vessel. For example, the first pole may be a north pole and the second pole may be a south pole. The magnet may be a permanent magnet of fixed magnetic field, or an electromagnet whose magnetic field may be controllably varied.

A mixture of the particulate feed and a ferrofluid is introduced into the separation vessel. The ferrofluid is preferably a stabilized aqueous suspension of ferrite particles. The particulate feed is thereafter permitted to separate into a first particle fraction comprising more of the first particle type than the second particle type, and a second particle fraction comprising more of the second particle type than the first particle type. The first particle fraction sinks in the ferrofluid of the separation vessel, and the second particle fraction floats (i.e., "levitates") in the ferrofluid of the separation vessel. The separation of the particle fractions may be aided by mild ultrasonic agitation or by the use of nonfoaming surfactants in the ferrofluid that promote the separation of the particles from each other.

Within this structure, the separation vessel may be any of several types. The separation vessel may be a closed vessel. The separation vessel may instead have an opening at its bottom in the manner of a funnel, from which the first particle fraction may be withdrawn. In either of these designs, the particulate feed is preferably allowed to separate quiescently. An advantage of this approach is that no apparatus with moving parts is required. The separation may be continued for as long as necessary to achieve the desired degree of separation. The use of the funnel-like structure allows the sample size with the particulate feed to be larger than the volume of the separation vessel, because part of the sample (i.e., some of the first particle fraction and the ferrofluid) is withdrawn out of the funnel during the separation process.

The separation vessel may instead be an elongated trough having a first end and a second end. The particulate feed is flowed along the elongated trough from the first end toward the second end. The first particle fraction and the second particle fraction are removed at the second end of the trough, or alternatively along the side walls along the length of the trough. To aid in the separation and removal, there may be provided a passive separator surface between the first end and the second end of the trough. The first particle fraction is removed from below the separator surface, and the second particle fraction is removed from above the separator surface. In this case, as with the closed vessel and funnel cases, the separation vessel is fully filled with the mixture of the particulate feed and the ferrofluid to the liquid level.

In either the flowing or nonflowing versions of the separation vessel, a portion of either the first particle fraction or (preferably) the second particle fraction may be recycled for further separation. For example, in the flowing-trough embodiment, the first particle fraction or (preferably) the second particle fraction is recycled to the first end as a recycled portion, and the recycled portion is reflowed along the elongated trough. In the recycling, the recycled portion is typically pumped, preferably with a peristaltic pump, from the second end to the first end of the elongated trough. In the present approach, the recycled portion is pumped essentially horizontally from the second end to the first end, facilitating particle transport. The recycling approach is particularly advantageous when used with the flowing versions of the separation vessel, because the residence time of the particulate feed in the separation in the absence of recycling is limited by the flow rate of the particulate feed and the length of the separation trough. The recycling approach may be used with the nonflowing versions of the separation vessel as well, although its benefits are not as significant in the nonflowing versions because in those cases the separation may continue for extremely long times without disturbance, even in the absence of recycling.

In a preferred application, after the separation of the particles fractions, at least one of the first particle fraction and the second particle fraction is analyzed. Typically, this analysis includes physically sizing and/or chemically typing the second particle fraction, but may include other testing as well.

Although a particular embodiment of the invention has been described in detail for purposes of illustration, various modifications and enhancements may be made without departing from the spirit and scope of the invention. Accordingly, the invention is not to be limited except as by the appended claims.

BRIEF DESCRIPTION OF THE DRAWINGS

FIG. 2 is a schematic cross-sectional view of a first embodiment of a separation apparatus;

FIG. 3 is a schematic cross-sectional view of a second embodiment of a separation apparatus.

DETAILED DESCRIPTION OF THE INVENTION

Figure 1:
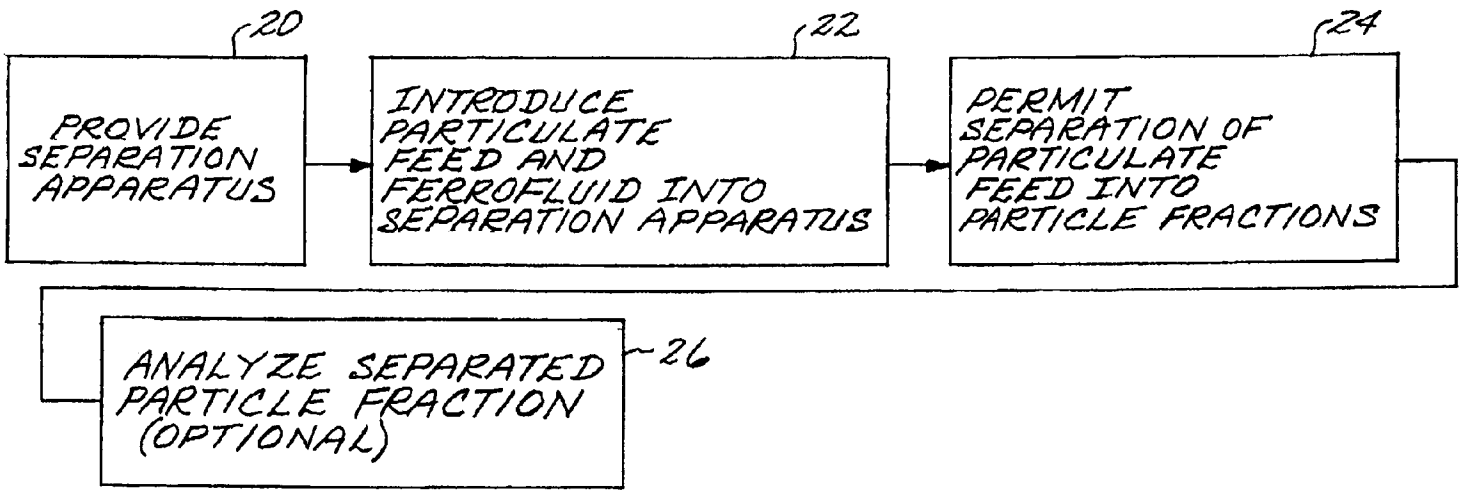
FIG. 1 is a block flow diagram of an approach to practicing an embodiment of the invention.
Figure 4:
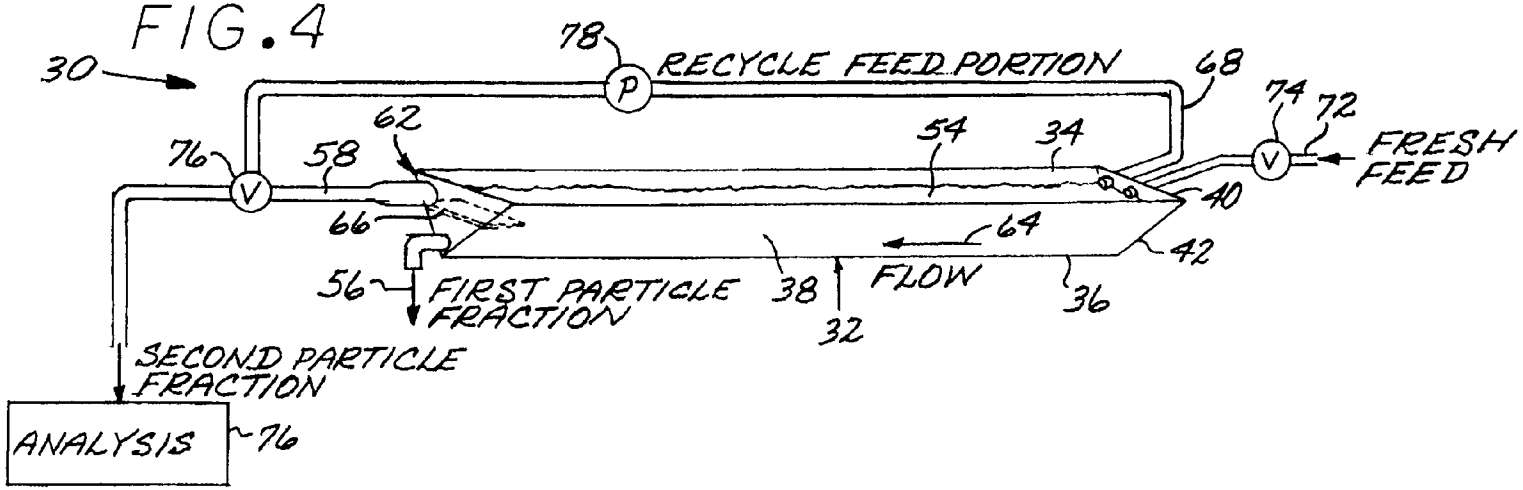
FIG. 4 is a schematic perspective sectional view of a third embodiment of a separation apparatus.

FIG. 1 depicts in block diagram form an embodiment of a method for separating a particulate feed comprising a first particle type and a second particle type. The method comprises first providing a separation apparatus 30. Three embodiments of the separation apparatus 30 are depicted in FIGS. 2–4. In each case, the separation apparatus 30 comprises a separation vessel 32 having a top 34 and a bottom 36. The separation vessel 32 includes inwardly sloping side walls 38. That is, there is a greater spacing between the side walls 38 at their top ends 40 than at their bottom ends 42. In the embodiment of FIG. 2, the bottom 36 of the separation vessel 32 is closed. In the embodiment of FIG. 3, the bottom 36 of the separation vessel 32 has a tube 44 extending downwardly therefrom. The separation vessels 32 of the embodiments of FIGS. 2 and 3 may be troughs that extend out of the plane of the illustration, or they may be conical (FIG. 2) or funnel-shaped (FIG. 3), or any other operable shape.

The separation apparatus 30 further includes a magnet structure 46 having a first pole 48 (illustrated as a north or N pole) positioned exterior to and adjacent to each of the side walls 38 of the separation vessel 32, and a second pole 50 (illustrated as a south or S pole) positioned above the separation vessel 32 and adjacent to the top 34 of the separation vessel 32. Flux lines 52 from the N pole to the S pole extend generally upwardly and inwardly from the side walls 38. The magnet structure 46 is illustrated in FIG. 2 as permanent magnets and in FIG. 3 as electromagnets, but either type of magnet structure may be used in either embodiment. The magnet structure 46 is not illustrated in FIG. 4 so that it does not obscure the other elements, but it may be either of the types of magnet structures illustrated in FIGS. 2 or 3, or any other operable type of magnet structure.

A mixture of the particulate feed and a ferrofluid 54 is introduced into the separation vessel 32, step 22. The particulate feed includes the first particle type and the second particle type. In a preferred application, the first particle type is a nonmagnetic metallic particle and the second particle type is a nonmagnetic ceramic particle of lower density than the metallic particle. The metallic particles are denser (heavier) than the ceramic particles. The ferrofluid is preferably a stabilized aqueous suspension of small ferromagnetic ferrite particles, typically $Fe_2O_3$ particles about 100 Angstroms in size. The stabilizer is preferably lignin sulfonate or other stabilizer. Ferrofluids are available commercially, as for example from Ferrotech USA. The ferrofluid may be modified by the introduction of a nonfoaming surfactant that aids in promoting the separation of the particles from each other to prevent clumping and reduces the surface tension of the ferrofluid. Such nonfoaming surfactants are known in the art for other applications.

The particulate feed is thereafter permitted to separate, step 24, into a first particle fraction 56 and a second particle fraction 58. The first particle fraction 54 comprises more of the first particle type than the second particle type. The first particle fraction 56 sinks in the ferrofluid 54 of the separation vessel 32. The second particle fraction 58 comprises more of the second particle type than the first particle type. The second particle fraction 58 floats in the ferrofluid 54 of the separation vessel 32. The separation 24 may be aided with the use of ultrasonic agitation to separate the particles from each other and to overcome the effects of gas bubbles that may be present.

The principles of the magnetic-assisted separation of particle fractions are known in the art, although they are not applied as in the present invention. See, for example, U.S. Pat. Nos. 3,483,968; 3,483,969; 3,488,531; 3,788,465; 3,951,785; 4,239,619; 4,594,149; 4,819,808; and 4,961,841, all of whose disclosures are incorporated herein in their entireties. Briefly, the applied magnetic field creates a pressure bias that aids in the flotation of the non-magnetic second particle fraction, against the gravity force.

An important feature of the structure of the separation apparatus 30 is the placement of the magnet structure 46 so that the second particle fraction 58 is biased to float in the ferrofluid toward the center of the top 34 of the separation vessel 32, and not toward the side walls 38. In some prior magnetic field-assisted particle-separation procedures, the floated fraction was biased toward, and adhered to, one or both of the walls of the separation enclosure. The result was that recovery of the floated particle fraction was difficult, and cleaning of the system prior to the next procedure was laborious. The open-top, readily accessible design of the separation vessel of the present approach, together with the arrangement of the magnetic structure 46, avoids these problems.

The embodiments of FIGS. 2–3 provide for essentially quiescent (nonflowing) separation of the particle fractions in step 24. (The use of ultrasonic agitation is within the scope of the quiescent separation, as the ultrasonic agitation does not produce a gross agitation of the separating mixture that would cause the particle fractions to remix, as shaking the separation vessel would do.) The period of quiescent separation may be continued for as long as necessary to achieve the desired degree of separation. The separation process of these two embodiments is similar, except that an initial mixture of the particle feed and the ferrofluid whose volume is larger than the volume of the separation vessel 32 may be introduced into the FIG. 3 embodiment, because a first particle fraction and some of the ferrofluid may be withdrawn downwardly through the funnel tube 44.

In another approach as illustrated in FIG. 4, the separation vessel 32 is provided as an elongated trough having a first end 60 and a second end 62, and a cross sectional shape and magnet structure as discussed in relation to the embodiments of FIGS. 2–3. In step 24, the particulate feed is flowed along the elongated trough from the first end 60 toward the second end 62, see flow-direction arrow 64. As the particulate feed travels along the length of the elongated trough, the first particle fraction 56 tends to settle for removal at a location between the first end 60 and the second end 62, and the second particle fraction 58 tends to float for removal at a location between the first end 60 and the second end 62. In the illustrated embodiment, separation is aided by providing a passive separator surface 66 at a location between the first end 60 and the second end 62 of the separation vessel trough 32. The first particle fraction 56 is removed from below the separator surface 66, and the second particle fraction 58 is removed from above the separator surface 66. The mixture of particles and ferrofluid may be ultrasonically agitated in this embodiment as well, to aid in the separation of the particle fractions.

Because the present process seeks to separate particle fractions of similarly sized particles and because the separation time is determined by the length of the trough and the flow rate through the trough, the separation in a single pass of the particulate feed through the flowing separator of FIG. 4 may not be sufficient to achieve the desired degree of separation. For example, in a single pass some of the first particles may float with the second particle fraction 58 and be mixed with the second particle fraction 58. To improve the separation efficiency, one or both of the first particle fraction and the second particle fraction may be recycled through the separation vessel 30. In the embodiment illustrated in FIG. 4, the second particle fraction 58 is recycled by pumping the second particle fraction 58 back to the first end 60 of the separation vessel trough 32 as a recycled portion 68, and reflowing the recycled portion 68 along the elongated separation vessel trough 32. The recycle pump 70 is preferably a peristaltic pump, which has no moving parts that contact the particles and the ferrofluid. During the recycling, the fresh particulate feed 72 may be shut off by a valve 74, or the specimen of the particulate feed may be exhausted.

When the second particle fraction 58 is sufficiently purified by the continuing recycling, a valve 76 may be reset to send the second particle fraction 58 to a collection vessel and thence to an analysis device 78 so that it may be analyzed, step 26. Such analysis 26 typically involves chemically, physically, or visually analyzing the second particle fraction 58. For the embodiments of FIGS. 2–3, after a sufficient separation of the first particle fraction 56 and the second particle fraction 58, the particle fraction of interest is similarly analyzed in step 28.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for separating a particulate feed comprising a first particle type and a second particle type, the method comprising the steps of providing a separation apparatus comprising a separation vessel having a top and a bottom, wherein the separation vessel includes inwardly sloping side walls with a greater spacing between the side walls at the top of the separation vessel than at the bottom of the separation vessel, and a magnet structure having a first pole positioned exterior of and adjacent to each of the side walls of the separation vessel, and a second pole positioned above the separation vessel; thereafter introducing a mixture of the particulate feed and a ferrofluid into the separation vessel; and thereafter permitting the particulate feed to separate into a first particle fraction comprising more of the first particle type than the second particle type, wherein the first particle fraction sinks in the ferrofluid of the separation vessel, and a second particle fraction comprising more of the second particle type than the first particle type, wherein the second particle fraction floats in the ferrofluid of the separation vessel away from the side walls of the separation vessel.

2. The method of claim 1, wherein the step of providing includes the step of providing the first pole as a north pole and the second pole as a south pole.

3. The method of claim 1, wherein the step of providing includes the step of providing the separation vessel as a closed vessel.

4. The method of claim 1, wherein the step of providing includes the step of providing the separation vessel with an opening at its bottom, from which the first particle fraction may be withdrawn.

5. The method of claim 1, wherein the step of permitting includes the step of permitting the particulate feed to separate quiescently.

6. The method of claim 1, wherein the step of providing includes the step of providing the separation vessel as an elongated trough having a first end and a second end, and wherein the step of permitting includes the step of flowing the particulate feed along the elongated trough from the first end toward the second end.

7. The method of claim 1, wherein the step of providing includes the step of providing the separation vessel as an elongated trough having a first end and a second end, and wherein the step of permitting includes the step of flowing the particulate feed along the elongated trough from the first end to the second end, wherein the first particle fraction and the second particle fraction are removed at positions between the first end and the second end.

8. The method of claim 7, wherein the step of providing includes the step of providing a passive separator surface between the first end and the second end of the trough, and wherein the step of flowing includes the steps of:

removing the first particle fraction from below the separator surface, and removing the second particle fraction from above the separator surface.

9. The method of claim 7, wherein the step of permitting includes the step of recycling a portion of one of the first particle fraction and the second particle fraction to the first end as a recycled portion, and reflowing the recycled portion along the elongated trough.

10. The method of claim 9, wherein the step of recycling includes the step of pumping the recycled portion from the second end to the first end of the elongated trough.

11. The method of claim 7, wherein the step of permitting includes the steps of:

recycling a portion of the second particle fraction to the first end as a recycled portion, and reflowing the recycled portion along the elongated trough.

12. The method of claim 1, wherein the step of permitting includes the step of ultrasonically agitating the mixture of the particulate feed and the ferrofluid.

13. The method of claim 1, wherein the step of introducing includes the step of introducing the first particle type as a metal and the second particle type as a ceramic.

14. The method of claim 1, wherein the step of introducing includes the step of providing the ferrofluid as a stabilized aqueous suspension of ferrite particles.

15. The method of claim 1, wherein the step of introducing a mixture of the particulate feed and the ferrofluid includes the step of providing the ferrofluid with a surfactant mixed therein.

16. The method of claim 1, wherein the step of providing includes the step of providing the magnet structure as a permanent magnet.

17. The method of claim 1, including an additional step, after the step of permitting, of analyzing at least one of the first particle fraction and the second particle fraction.

18. The method of claim 1, including an additional step, after the step of permitting, of physically sizing the second particle fraction.

* * * * *